US010994322B2

(12) United States Patent
Nogami et al.

(10) Patent No.: US 10,994,322 B2
(45) Date of Patent: May 4, 2021

(54) ROLLER HEMMING APPARATUS AND ROLLER HEMMING METHOD

(71) Applicant: SUBARU CORPORATION, Tokyo (JP)

(72) Inventors: Yosei Nogami, Tokyo (JP); Seiichi Ishizeki, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 223 days.

(21) Appl. No.: 15/795,536

(22) Filed: Oct. 27, 2017

(65) Prior Publication Data

US 2018/0133780 A1 May 17, 2018

(51) Int. Cl.
*B21D 39/02* (2006.01)
*B21D 53/88* (2006.01)

(52) U.S. Cl.
CPC ..... *B21D 39/023* (2013.01); *B21D 53/88* (2013.01)

(58) Field of Classification Search
CPC ..... B21D 39/023; B21D 53/88; B21D 39/02; Y10T 29/53787; Y10T 29/53791
USPC ..... 72/220, 214
See application file for complete search history.

(56) References Cited

U.S. PATENT DOCUMENTS 5,267,387 A * 12/1993 Sawa ..... B21D 39/021 29/509
8,272,243 B2 * 9/2012 Hasegawa ..... B21D 19/043 29/243.5
2012/0204412 A1 * 8/2012 Carsley ..... B21D 39/023 29/509

FOREIGN PATENT DOCUMENTS

DE 10111374 A1 * 9/2002 ..... B21D 39/021
JP 2005-014069 A1 1/2005
JP 2005014069 A * 1/2005
JP 2011-41972 A 3/2011

OTHER PUBLICATIONS

First Office Action issued in corresponding Chinese Patent Application No. 201710968981.2 dated Apr. 15, 2020, with machine translation.

* cited by examiner

*Primary Examiner* — Teresa M Ekiert
(74) *Attorney, Agent, or Firm* — Troutman Pepper Hamilton Sanders LLP

(57) ABSTRACT

A roller hemming apparatus includes a receiving body including a receiving member coming into contact with an edge of a panel workpiece, a roller body including a roller member bending a panel flange at the edge of the workpiece toward the receiving member, and a movement unit moving the roller body along the edge and tilts up or down the roller body toward the flange. The roller member hems the flange through the tilting-up operation of the roller body. One of the receiving and roller bodies includes a guide recess and the other includes a convex curved surface coming into sliding contact with the recess. The recess and the surface have a same curvature. The roller body is tilted up to bend the flange or tilted down to move away from the flange around a center of curvature common to the surface and the recess that come into sliding contact.

20 Claims, 12 Drawing Sheets

ROLLER HEMMING APPARATUS AND ROLLER HEMMING METHOD

CROSS-REFERENCE TO RELATED APPLICATIONS

The present application claims priority from Japanese Patent Application No. 2016-216036 filed on Nov. 14, 2016, the entire contents of which are hereby incorporated by reference.

TECHNICAL FIELD

The present invention relates to a roller hemming apparatus and a roller hemming method that enable a bending angle of a flange formed in a panel workpiece to be continuously varied during the process of hemming.

BACKGROUND

There is known a hemming apparatus that performs hemming processing (or hem processing) by bending a flange formed on the peripheral edge of a door panel, a side panel, a hood, a quarter panel or other panel workpiece of a vehicle.

Japanese Unexamined Patent Application Publication No. 2005-14069, for instance, discloses a technique by which a receiving roller and a compaction roller provided at the end of an arm of one or two robots hold and compress a flange formed on the edge of a panel workpiece therebetween and, in such a state, they are rolled along the flange, thereby performing hemming processing on the edge.

When hemming processing is performed on a flange formed on the edge of a panel workpiece, the flange is first bent at a sharp angle in a preliminary bending stage and is then folded back in a final bending stage. The bending angle of the flange is determined by the shape of the compaction roller. This necessitates replacing the compaction roller with one of a suitable shape in each of the stages in which the flange is bent and folded back, which may result in disadvantages such as a longer setup time and an increase in production man-hours.

Likewise, when hemming processing is performed on a wheel arch formed in a rear quarter panel of a vehicle body, a given point on the wheel arch becomes closer to a tire as it moves closer to the top center position from either one of both ends of the wheel arch. Accordingly, the flange is bent at approximately 90 degrees at a position close to either one of both ends of the wheel arch in order to ensure bending strength, while the flange is folded back at a position close to the top in order to ensure an appropriate distance from the tire.

As described above, in cases where the bending angle of the flange differs from one region to another, it is necessary to replace the compaction roller with one of a suitable shape before starting hemming processing, which may result in disadvantages such as a longer setup time and an increase in production man-hours.

SUMMARY

It is desirable to provide a roller hemming apparatus and a roller hemming method that, when a flange is bent and folded in the hemming process, can eliminate the need for replacing a compaction roller with one corresponding to a bending angle, thereby achieving a reduction in setup time and a consequent reduction in production man-hours.

A first aspect of the present invention provides a roller hemming apparatus that includes a receiving body having a receiving member that comes into contact with an edge of a panel workpiece, a roller body having a roller member that bends a panel flange formed at the edge of the panel workpiece toward the receiving member, and a movement unit that moves the roller body along the edge of the panel workpiece and, to tilt up or down the roller body toward the panel flange, in which either one of the receiving body and the roller body has a guide recess and the other has a convex curved surface that comes into sliding contact with the guide recess, in which the guide recess and the convex curved surface have a same curvature, and in which the roller body is tilted up so as to bend the panel flange or tilted down so as to move away from the panel flange around a center of curvature common to the convex curved surface and the guide recess that are in sliding contact with each other.

A second aspect of the present invention provides a roller hemming method by which a receiving member provided on a receiving body may be brought into contact with an edge of a panel workpiece and a panel flange formed at an edge of the panel workpiece may be bent by a roller member provided on a roller body toward the receiving member and, at the same time, the roller body may be moved along an edge of the panel workpiece so as to hem the panel flange, in which a guide recess having a predetermined curvature may be formed in either one of the receiving body and the roller body and a convex curved surface having the same curvature as the guide recess may be formed in the other, and in which the guide recess may be brought into sliding contact with the convex curved surface and the roller body may be tilted up or down around a center of curvature common to the guide recess and the convex curved surface, thereby varying the bending angle of the panel flange.

BRIEF DESCRIPTION OF THE DRAWINGS

FIG. 2A is a cross-sectional view of an initial region E1. FIG. 2B is a cross-sectional view of a preliminary bending region E2. FIG. 2C is a cross-sectional view of a final bending region E3;

FIG. 4A is a side view at the start of hemming. FIG. 4B is a side view at the time of preliminary bending. FIG. 4C is a side view at the time of final bending;

FIG. 12A is a side view before hemming. FIG. 12B is a side view at the start of hemming. FIG. 12C is a side view at the time of preliminary bending. FIG. 12D is a side view at the time of final bending.

DETAILED DESCRIPTION

An example of the present invention will be described below with reference to the attached drawings.

FIGS. 1 through 9 illustrate an example of the present invention. Following is a description of hemming processing performed on a rear wheel arch 2*a* as an edge formed in a rear quarter panel 2 as a panel workpiece provided in a body structure 1.

The rear quarter panel 2 is joined to the body structure 1 illustrated in FIG. 1 in a non-removal manner, and the rear wheel arch 2*a* is formed in the rear quarter panel 2. The rear wheel arch 2*a* defines an edge of a side opening of a wheel house (not illustrated) that houses a tire 3. The rear wheel arch 2*a* is positioned far enough from the tire 3 to avoid contact therebetween even when the tire 3 bounds upward during travelling of a vehicle.

Figure 2A:
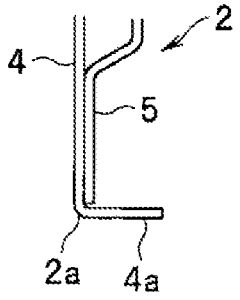
FIGS. 2A through 2C are cross-sectional views of various regions illustrated in FIG. 1B.
Figure 2B:
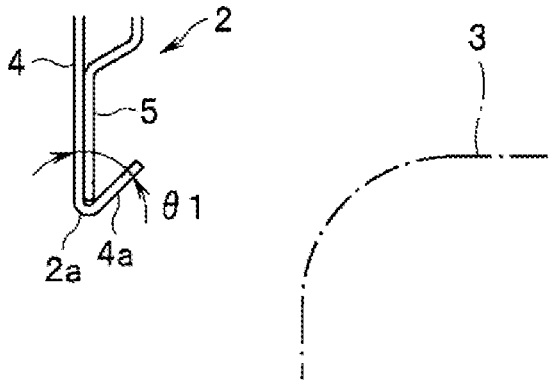
Figure 2C:
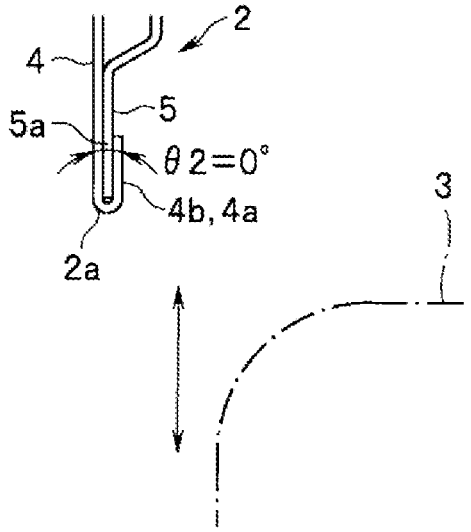

As illustrated in FIGS. 2A through 2C, the rear quarter panel 2 has an outer panel 4 as a first panel workpiece and an inner panel 5 as a second panel workpiece. The inner panel 5 is joined in a non-removal manner to the inner surface of the outer panel 4 by means of spot welding. The outer panel 4 has a flange (hereinafter referred to as "panel flange") 4*a* formed along its edge that is defined by the rear wheel arch 2*a*. The panel flange 4*a* extends inward from the edge. The panel flange 4*a* is formed by bending the edge at a predetermined angle (for instance, 90 degrees) during the process of press forming and is subjected to hemming processing by a roller hemming apparatus 21 to be described later.

Figure 1A:
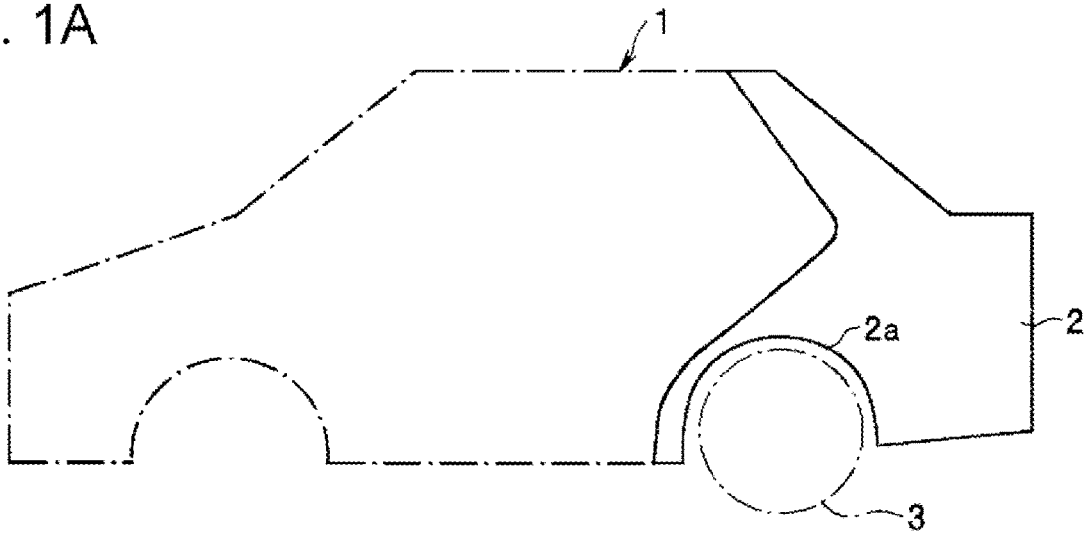
FIG. 1A is a schematic side view of a rear quarter panel where a rear wheel arch has been hemmed according to a first example of the present invention.
Figure 1B:
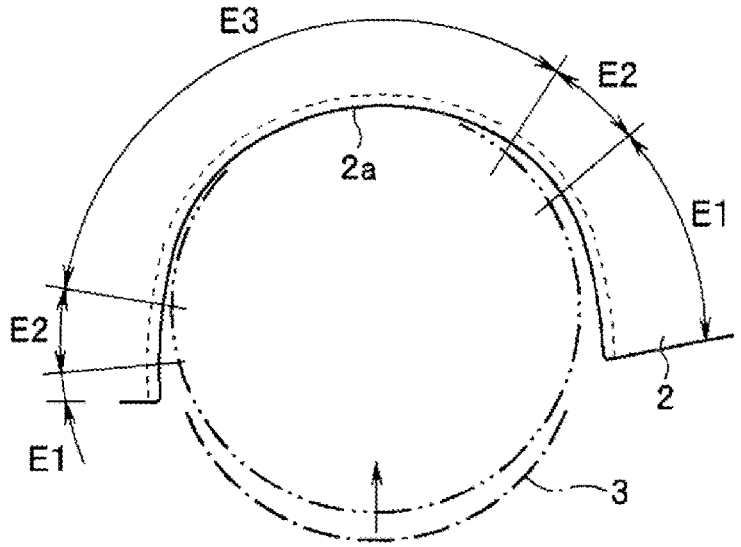
FIG. 1B is an enlarged view of the rear wheel arch of FIG. 1A.

In addition, as illustrated in FIG. 1B, an end 5*a* of the inner panel 5 disposed close to the rear wheel arch 2*a* is formed so as to run along the rear wheel arch 2*a* and is joined to the inner surface of the outer panel 4.

When the section strength (or section modulus) of the rear wheel arch 2*a* is considered, it is preferable that the angle of the panel flange 4*a* remains at approximately 90 degrees at which the panel flange 4*a* is bent during press forming. However, as a result of a recent exterior design trend toward a narrower clearance (or shorter distance) between the rear wheel arch 2*a* and the tire 3, if the tire 3 bounds upward from a position indicated by a dashed-dotted line in FIG. 1B to a position indicated by a dashed-two-dotted line due to road surface irregularities during travelling of a vehicle, the tire 3 may enter the inside of the upper part of the rear wheel arch 2*a*.

For this reason, part of the panel flange 4*a* within the upper part of the rear wheel arch 2*a* needs to be folded back in order to avoid coming into contact with the tire 3. At this time, a folded-back portion 4*b* of the panel flange 4*a* and the outer panel 4 hold an end 5*a* of the inner panel 5 therebetween, thereby ensuring strength.

In this example, a section of the panel flange 4*a* within the initial region E1 close to both ends that is unlikely to come into contact with the tire 3 illustrated in FIG. 1B maintains an angle (for instance, 90 degrees) associated with press forming, as illustrated in FIG. 2A. In addition, a section of the panel flange 4*a* within the final bending region E3 that is likely to come into contact with the bounded tire 3 is folded back toward the inner surface of the outer panel 4 (angle θ2: 0 degrees), thereby causing the outer panel 4 and the panel flange 4 to hold the end 5*a* of the inner panel 5 therebetween, as illustrated in FIG. 2C. Furthermore, a section of the panel flange 4*a* within the preliminary region E2 between the initial region E1 and the final bending region E3 is bent to some degree at a position close to the initial region E1 until forming a predetermined angle θ1 (for instance, 45 degrees) and, at a position close to the final bending region E3, is further bent and folded back so as to extend to the folded-back portion 4*b*, as illustrated in FIG. 2B.

Figure 3:
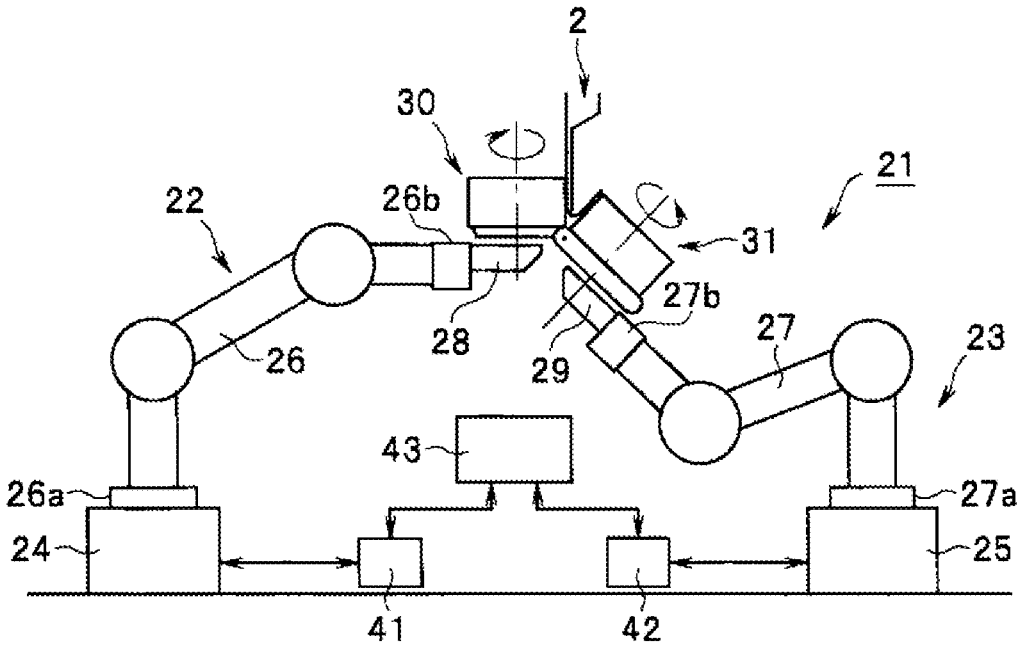
FIG. 3 is a schematic configuration diagram of a hemming apparatus.

Bending and folding of the panel flange 4*a* from the preliminary bending region E2 to the final bending region E3, as described above, is performed by the roller hemming apparatus 21. As illustrated in FIG. 3, the roller hemming apparatus 21 has first and second hemming robots 22, 23 as moving units that are installed in a hemming work area that is set up in advance.

Both of the hemming robots 22, 23 are disposed so as to oppose each other with the rear quarter panel 2 of the body structure 1 therebetween. Main body bases 26*a*, 27*a* of robot arms 26, 27 are rotatably supported by robot mounts 24, 25 secured to the work area for the hemming robots 22, 23. In addition, first and second roller bases 28, 29 are supported by wrist shafts 26*b*, 27*b*, respectively, provided on ends of the robot arms 26, 27. Furthermore, a rotating shaft 32 of a first roller body 30 as a receiving body and a rotating shaft 33 of a second roller body 31 as a roller body are supported by the roller bases 28, 29, respectively.

Figure 4A:
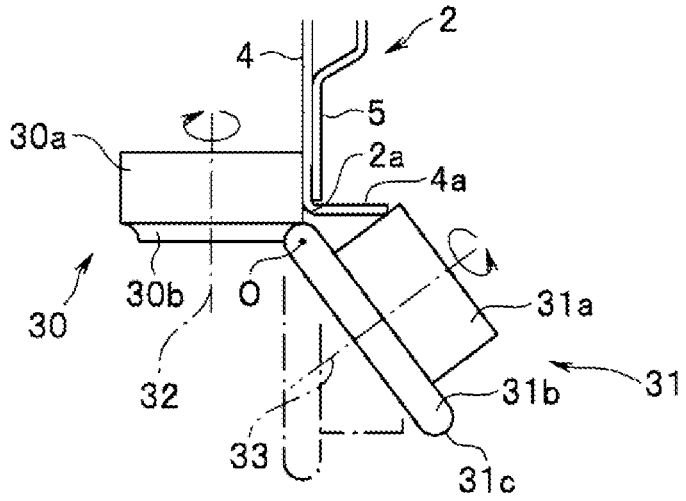
FIGS. 4A through 4C illustrate a positional relationship between a first roller and a second roller during hemming processing.

As illustrated in FIG. 4, the first roller body 30 has a receiving first roller 30*a* as a receiving member that is pressed against an outer surface of the rear quarter panel 2. The first roller 30*a* has a guide recess 30*b* formed at a base thereof in the shape of a ring. On the other hand, the second roller body 31 has a second roller 31*a* as a roller. The second roller 31*a* is a compaction roller for bending the panel flange 4*a* by applying a pressing force to the panel flange 4*a* and has a roller flange 31*b* formed at a base thereof. The guide recess 30*b* of the first roller body 30 is shaped in the form of a circular arc-like recess having a predetermined radius, while the roller flange 31*b* has a circular arc-shaped convex curved surface 31*c* formed at an outer edge thereof. The convex curved surface 31*c* has the same curvature (same radius) as the guide recess 30*b*.

When hemming processing is performed on the panel flange 4*a*, the guide recess 30*b* of the first roller body 30 and the convex curved surface 31*c* of the roller flange 31*b* of the second roller body 31 are rolled while in constant contact with each other. In other words, as illustrated in FIG. 4, the first roller 30*a* of the first roller body 30 is brought into contact with the outer edge of the rear wheel arch 2*a* of the outer panel 4. On the other hand, the rotating shaft 33 of the second roller body 31 is tilted up toward the rotating shaft 32 of the first roller body 30 from a standby position while the convex curved surface 31*c* is in constant contact with the guide recess 30*b* of the first roller body 30.

Figure 4B:
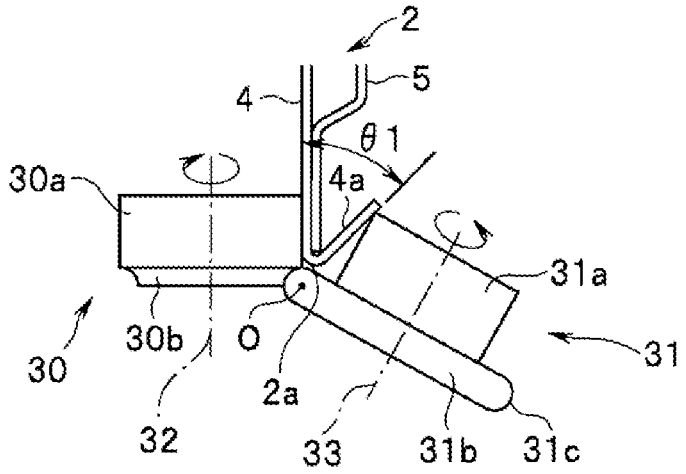

When the rotating shaft 33 of the second roller body 31 is tilted up toward the rotating shaft 32 of the first roller body 30, the second roller 31*a* presses and bends the panel flange 4*a* at a sharp angle (see FIG. 4B). When the rotating shaft 33 of the second roller body 31 is tilted up to a position at which the rotating shaft 33 becomes parallel to the rotating shaft 32 of the first roller body 30, the first roller 30*a* and the second roller 31*a* become parallel to each other, causing the panel flange 4*a* to be folded back at an angle θ2 of 0 degrees with the end 5*a* of the inner panel 5 held between the panel flange 4*a* and the outer panel 4 (see FIG. 4C).

Figure 4C:
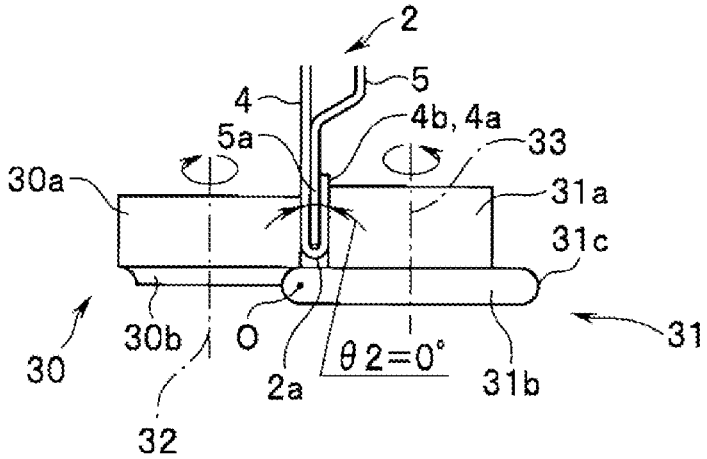

Accordingly, as illustrated in FIG. 4C, when both of the rotating shafts 32, 33 are parallel to each other in the same plane, the clearance between the first roller 30*a* of the first roller body 30 and the second roller 31*a* of the second roller body 31 is configured to be equal to the sum of the thicknesses of the outer panel 4, the panel flange 4*a*, and the end 5*a* of the inner panel 5, thereby enabling the panel flange 4*a* to be folded back.

The guide recess 30*b* of the first roller body 30 and the convex curved surface 31*c* formed at the outer edge of the roller flange 31*b* of the second roller body 31 have the same curvature. For this reason, when the convex curved surface 31*c* is brought into sliding contact with the guide recess 30*b*, the guide recess 30*b* and the convex curved surface 31*c* that are in contact with each other on a line coincide with each other in terms of the center of curvature O and, as a result, are properly positioned. Accordingly, the second roller body 31 can be tilted up and down around the common center of curvature O by causing the convex curved surface 31*c* to be supported by the guide recess 30*b*.

In addition, in this example, the center of curvature O common to the guide recess 30*b* and the convex curved surface 31*c* is configured to lie along an extension of the surface of the outer panel 4. In other words, the guide recess 30*b* formed in the first roller body 30 is configured to have the center of curvature O of the rounded surface lying along an extension of the surface of the first roller 30*a*.

Furthermore, reference numerals 41 and 42 refer to first and second robot controllers that cause the first and second hemming robots 22, 23 to provide control action, while reference numeral 43 refers to a main controller that performs coordinated control of both of the robot controllers 41, 42. These controllers are composed mainly of well-known microcomputers provided with a CPU, a RAM, a ROM and the like, while, in accordance with pre-stored instructions for the first and second hemming robots 22, 23, the main controller 43 sends a command signal to the first and second controllers 41, 42, causing the first and second hemming robots 22, 23 to provide control action through the robot controllers 41, 42.

More specifically, the main controller 43 causes the first and second hemming robots 22, 23 to reciprocate the first and second roller bodies 30, 31 on the rear wheel arch 2*a*, thereby completing hemming processing.

Figure 5:
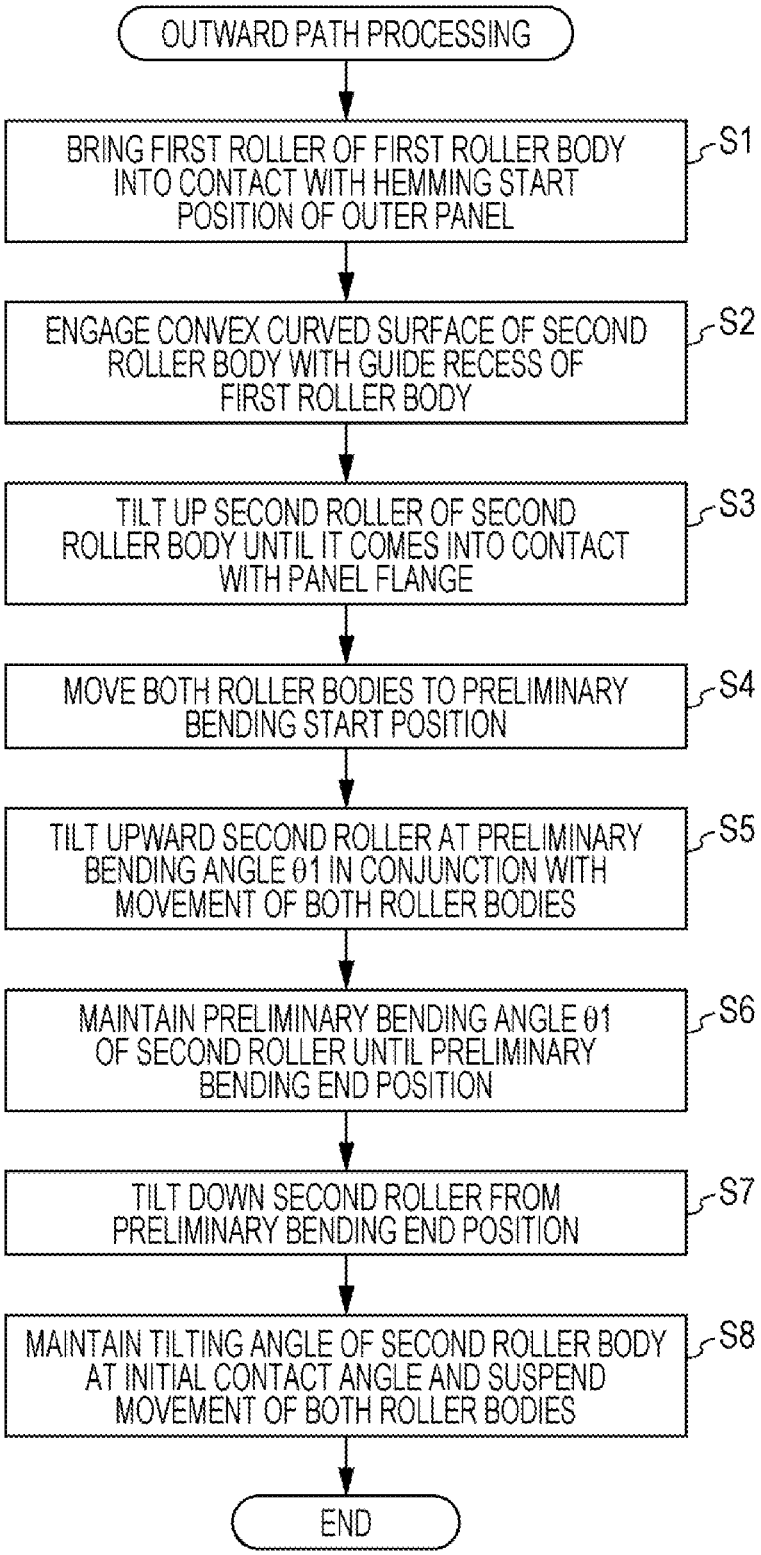
FIG. 5 is a flowchart illustrating an outward path processing routine for hemming processing.
Figure 6:
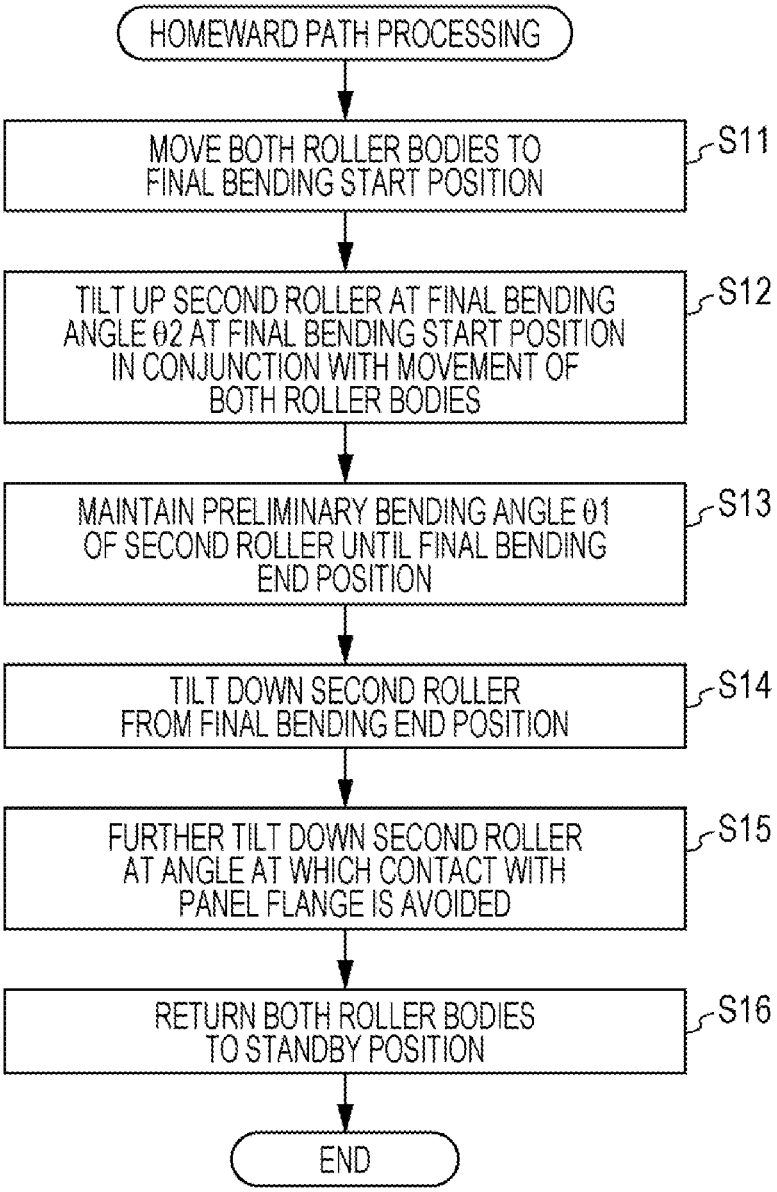
FIG. 6 is a flowchart illustrating a homeward path processing routine for hemming processing.
Figure 7A:
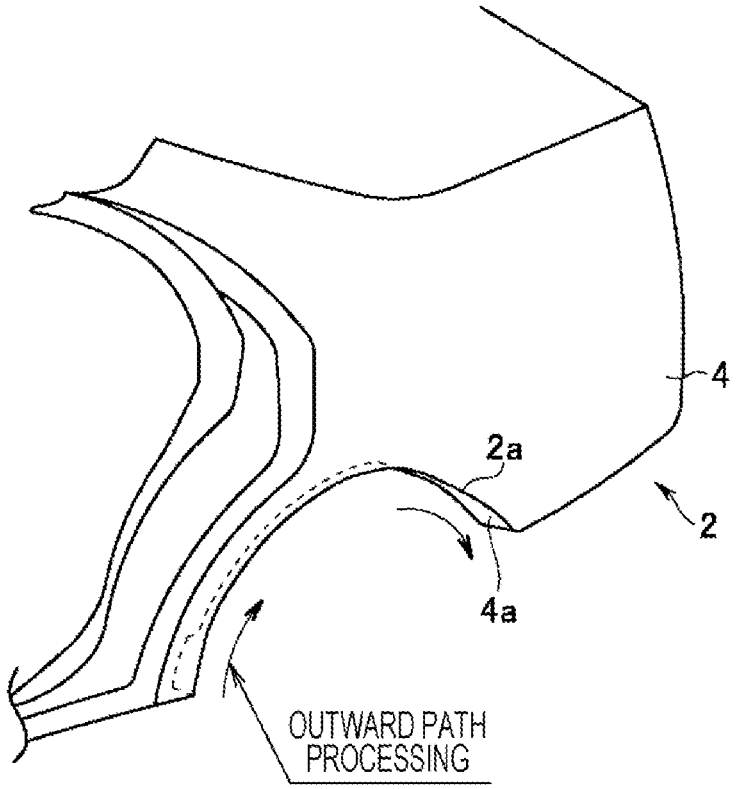
FIG. 7A is a perspective view of a rear quarter panel illustrating hemming processing performed in an outward path.
Figure 7B:
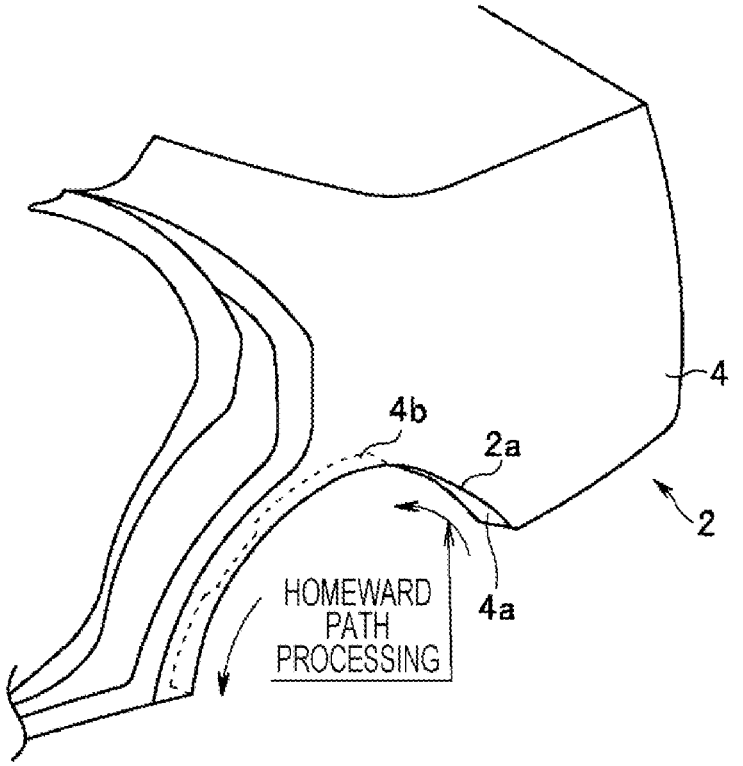
FIG. 7B is a perspective view of a rear quarter panel illustrating hemming processing performed in a homeward path.

Hemming processing control by the main controller 43 is specifically performed in accordance with an outward path processing routine illustrated in FIG. 5 and a homeward processing routine illustrated in FIG. 6. In this example, the hemming processing starts at the front portion of the rear wheel arch 2*a* during the processing for the outward path, as illustrated in FIG. 7A, while the hemming processing is performed from the rear to the front during the processing for the homeward path.

After the body structure 1 is transferred to the hemming work area, the main controller 43 performs the outward path processing routine illustrated in FIG. 5. When this routine is started, the robot arms 26, 27 of the first and second hemming robots 22, 23 are operated in coordination with each other in step S1. Then, the first roller 30*a* of the first roller body 30 supported by the first roller base 28 secured to the wrist shaft 26*b* of the first hemming robot 22 is brought into contact with a hemming start position on the surface of the outer panel 4 that constitutes the rear quarter panel 2, namely, the initial region E1 located at the front portion of the rear wheel arch 2*a* illustrated in FIG. 1B.

Figure 8A:
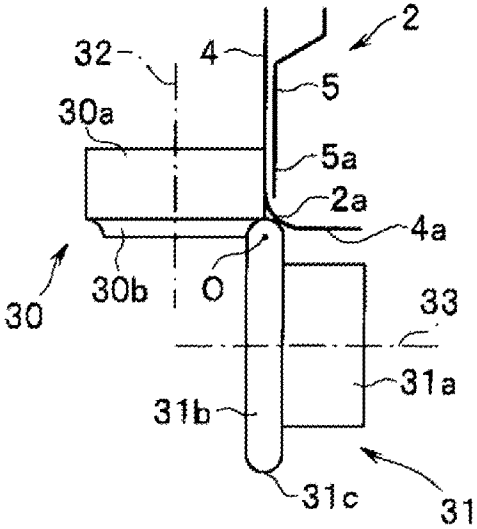
FIGS. 8A through 8E are cross-sectional views illustrating bending processing performed on various regions in a rear wheel arch during outward-path bending processing.
Figure 8B:
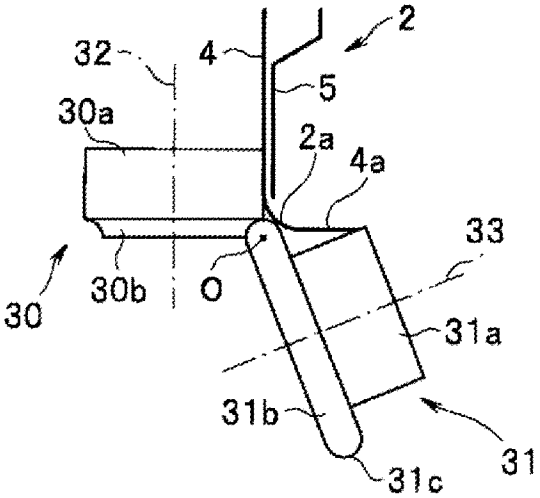

At this time, the center of curvature O for the rounded surface of the guide recess 30*b* formed in the first roller body 30 lies along an extension of the surface of the outer panel 4. In addition, before or after the first roller 30*a* of the first roller body 30 is brought into contact with the outer panel 4, the second roller body 31 is brought closer to the first roller body 30 through the operation of the second hemming robot 23. Specifically, the rotating shaft 33 of the second roller body 31 is placed at a position perpendicular to the rotating shaft 32 of the first roller body 30 and, in this state, the second roller body 31 is brought closer to the panel flange 4*a* in the direction in which contact with the panel flange 4*a* is avoided, for instance, in an upward direction, as illustrated in FIG. 8A.

The flow proceeds to step S2 in which the convex curved surface 31*c* formed at the outer edge of the roller flange 31*b* of the second roller body 31 is brought into contact with the guide recess 30*b* of the first roller body 30. Then, the centers of curvature O of the guide recess 30*b* and the convex curved surface 31*c* are matched with each other on an extension of a contact zone between the first roller 30*a* and the outer panel 4 and are consequently set in place (see FIG. 8A).

The flow proceeds to step S3 in which, through the operation of the second hemming robot 23, the second roller 31*a* of the second roller body 31 is tilted up until coming into contact with the panel flange 4*a* while the sliding contact between the convex curved surface 31*c* and the guide recess 30*b* and the matching of the centers of curvature C are maintained. After the second roller 31*a* comes into contact with the panel flange 4*a* (see FIG. 8B), the flow proceeds to step S4.

In step S4, a control signal is sent to both of the robot controllers 41, 42 to, through the coordinated motion of both of the hemming robots 22, 23, move both of the roller bodies 31, 32 along the rear wheel arch 2*a* to a preliminary bending start position, namely, close to a boundary between the preliminary bending region E2 and the initial region E1 at the front portion illustrated in FIG. 1B.

Figure 8C:
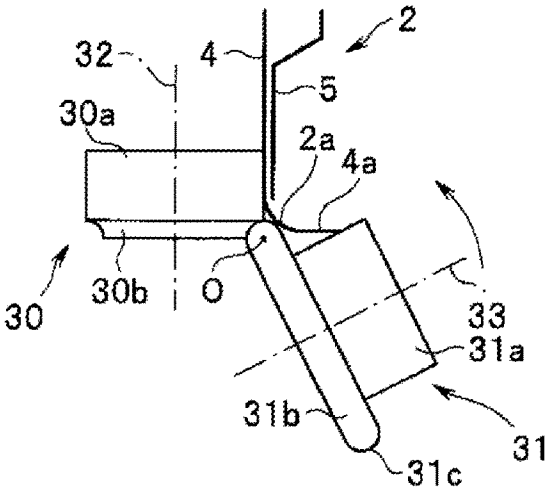

After both of the roller bodies 30, 31 reach the preliminary bending start position, the flow proceeds to step S5 in which preliminary bending is started (see FIG. 8C). More specifically, in step S5, through the coordinated motion of the hemming robots 22, 23, the roller bodies 30, 31 are moved along the rear wheel arch 2*a* and, at the same time, the second roller body 31 is tilted up at a predetermined preliminary bending angle θ1 (for instance, 45 degrees) with the centers of curvature O being matched. This causes the second roller 31*a* to press the panel flange 4*a* in the direction of the first roller 30*a*. As the second roller body 31 is tilted up, the panel flange 4*a* is gradually bent and folded, while the roller bodies 30, 31 are rolled.

Figure 8D:
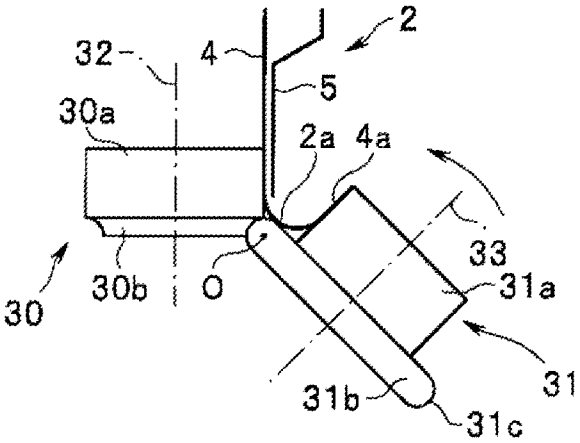
Figure 8E:
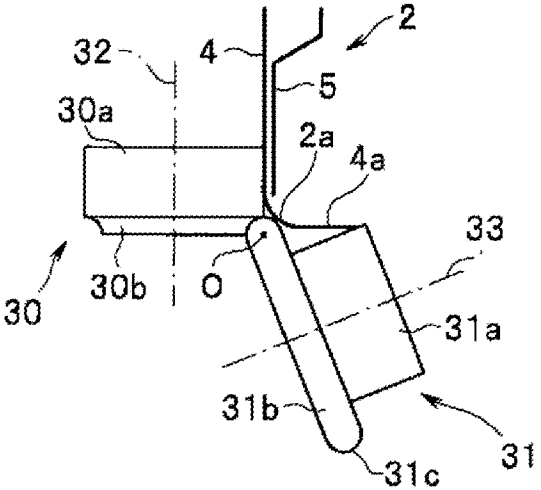

After the angle of the second roller body 31 reaches a predetermined preliminary bending angle θ1, the flow proceeds to step S6 in which, with this predetermined preliminary bending angle θ1 being maintained, the roller bodies 30, 31 are moved along the rear wheel arch 2*a* to the end position of the preliminary bending region E2, namely close to a boundary with the initial region E1 at the rear portion of the vehicle (see FIG. 8D). At this time, as illustrated in FIG. 4B, a section of the panel flange 4*a* extending from the preliminary bending region E2 at the front portion to the final bending region E3 to the preliminary bending region E2 at the rear portion is bent at the preliminary bending angle θ1 along the inclined second roller 31*a*.

Then, when the roller bodies 30, 31 are moved to the end of the preliminary region E2, namely, close to a boundary with the initial region E1 at the rear of the vehicle, the preliminary bending is completed and the flow proceeds to step S7.

In step S7, through the coordinated motion of both of the hemming robots 22, 23, the second roller body 31 is tilted down at an initial contact angle of the panel flange 4*a* obtained before the preliminary bending, namely, an angle at which the second roller body 31*a* comes into contact with the panel flange 4*a* bent at 90 degrees by means of press forming with the centers of curvature O being matched, while the roller bodies 30, 31 are being moved along the rear wheel arch 2*a*. Then, when the second roller body 31 is tilted at the initial contact angle (see FIG. 8E), the flow proceeds to step S8.

In step S8, with the tilting-down angle of the second roller body 31 being maintained at the initial contact angle, the motion of the hemming robots 22, 23 is suspended and the routine is terminated.

Figure 9A:
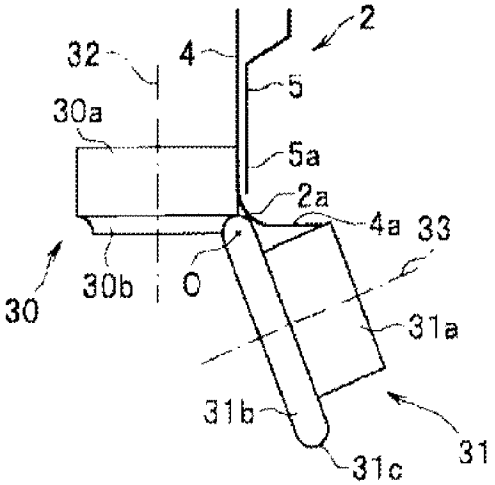
FIGS. 9A through 9E are cross-sectional views illustrating bending processing performed on various regions in a rear wheel arch during homeward-path bending processing.

Next, the main controller 43 performs the homeward path processing routine illustrated in FIG. 6. As illustrated in FIG. 9A, in accordance with this homeward path processing routine, the first and second roller bodies 30, 31 that are suspended at the preliminary bending end position by the outward processing routine described above are rolled along the rear wheel arch 2 *a* from the rear to the front of the vehicle through the motion of the first and second hemming robots 22, 23. During this process, in the final bending region E3 illustrated in FIG. 1B, the preliminarily bent panel flange 4 *a* is finally bent at an angle of θ2 (=0 degrees), thereby forming the folded-back portion.

In step S11, when this routine is started, through the motion of the hemming robots 22, 23, the roller bodies 30, 31 are moved as a single unit along the rear wheel arch 2*a* to a final bending position, namely, close to a boundary between the preliminary bending region E2 and the final bending region E3. Then, when the roller bodies 30, 31 reach the final bending position, the flow proceeds to step S12 in which final bending is started.

Figure 9B:
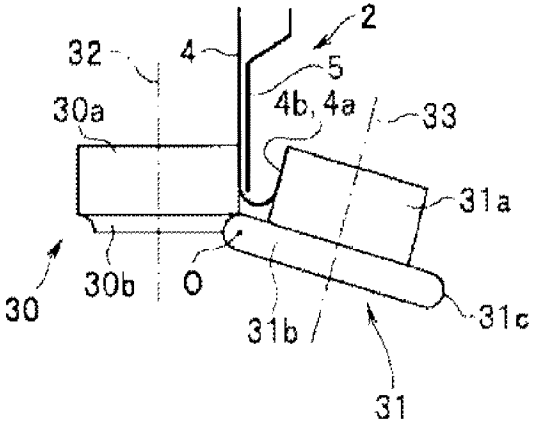

In step S12, through the coordinated motion of the hemming robots 22, 23, the roller bodies 30, 31 are moved along the rear wheel arch 2 *a* and, at the same time, the second roller body 31 is tilted up at a predetermined final bending angle θ2 (=0 degrees) with the centers of curvature O being matched. As illustrated in FIG. 9B, this causes the second roller 31 *a* to press the panel flange 4 *a* in the direction of the first roller 30 *a*. As the second roller body 31 is tilted up, the panel flange 4 *a* is further bent and folded from the preliminarily bent angle, while the roller bodies 30, 31 are rolled. After the angle of the second roller body 31 reaches the final bending angle θ2, the flow proceeds to step S13.

Figure 9C:
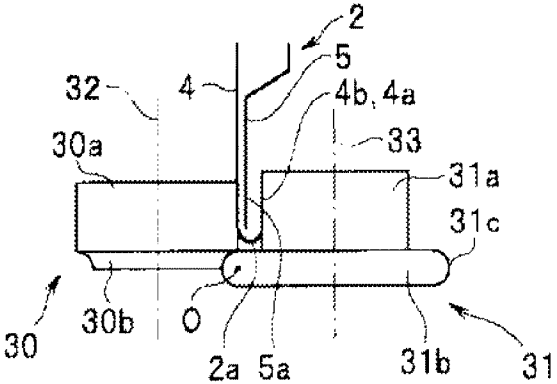
Figure 9D:
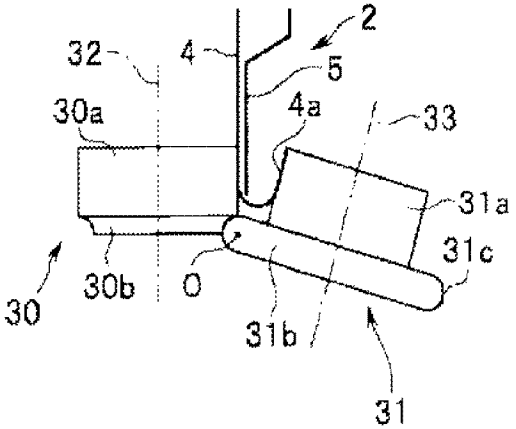
Figure 9E:
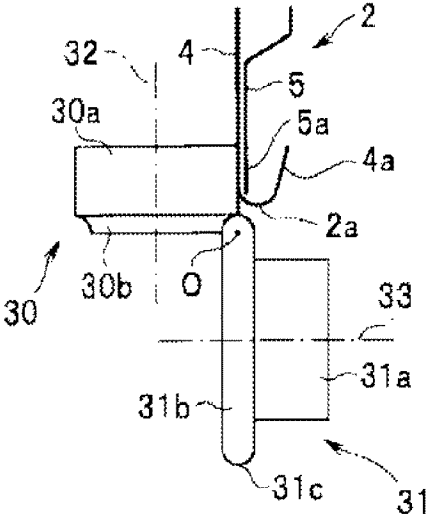

In step S13, with this final bending angle θ2 being maintained, the roller bodies 30, 31 are moved to the final bending end position, namely, close to a boundary with the preliminary bending region E2 (see FIG. 9C). As illustrated in FIG. 4C, when the second roller body 31 is tilted up at the final bending angle θ2 (=0 degrees), the second roller 31 *a* becomes parallel to the first roller 30 *a*. At this time, the clearance between the first roller 30 *a* and the second roller 31 *a* is configured to be substantially equal to the sum of the thicknesses of the outer panel 4, the panel flange 4 *a*, and the inner panel 5. Note that the center of curvature O is configured to lie along an extension of the surface of the outer panel 4.

Consequently, when the roller bodies 30, 31 are rolled in the final bending region E3 with the final bending angle θ2 being maintained, the panel flange 4*a* is folded back with the end 5*a* of the inner panel 5 between itself and the outer panel 4, thereby forming the folded-back portion. Then, the roller bodies 30, 31 are moved to the end of the final bending region E3, namely, close to a boundary with the preliminary bending region E2 at the front portion of the vehicle, the final bending is completed and the flow proceeds to step S14.

In step S14, while the roller bodies 30, 31 are moved along the rear wheel arch 2 *a* through the coordinated motion of the hemming robots 22, 23, the second roller body 31 is tilted down at the preliminary bending angle θ1 of the preliminarily bent panel flange 4 *a* with the centers of curvature O being matched. Then, when the second roller body 31 is tilted down at the preliminary bending angle θ1 (see FIG. 9D), the flow proceeds to step S15.

In step S15, the second roller body 31 is further tilted down at an angle (for instance, 90 degrees) at which contact with the panel flange 4*a* is avoided. Then, the flow proceeds to step S16 in which the roller bodies 30, 31 are returned to the standby position through the motion of the first and second hemming robots 22, 23 and the routine is terminated.

As described above, in this example, the guide recess 30*b* formed in the first roller body 30 and the convex curved surface 31*c* formed at the outer circumference of the roller flange 31*b* of the second roller body 31 are configured to have the rounded surfaces having the same curvature, and the guide recess 30*b* is in sliding contact with the convex curved surface 31*c*. With the first roller 30*a* of the first roller body 30 being in contact with the outer surface of the outer panel 4, the second roller body 31 is configured to be tilted up with the centers of curvature O being matched. This arrangement improves the positional stability of the second roller 31*a* of the second roller body 31 when the second roller 31 bends the panel flange 4*a*, thereby making it possible to use the tilting-up angle of the second roller body 31 to precisely set the bending angle of the panel flange 4*a*.

Consequently, when the panel flange 4*a* is bent and folded in stages during hemming processing, the compaction roller needs not be replaced to meet the change of the bending angle unlike conventional methods. This enables the bending angle to be continuously varied, thereby achieving a reduction in setup time and a consequent reduction in production man-hours.

In addition, the panel flange 4*a* can be set to any bending angle through the configuration of the tilting-up angle of the second roller body 31, making this hemming method more versatile. Though, in this example, the hemming processing is completed through the process of bending the panel flange 4*a* in stages in one round trip, the hemming processing may be completed through the process of bending the panel flange 4*a* in stages in one or more round trips.

Furthermore, the first roller body 30 may consist of a hemming die that is mounted in the shape of a table. In this case, the guide recess 30*b* is formed along the wheel arch 2*a* formed in the rear quarter panel 2 mounted on the hemming die. The roller flange 31*b* of the second roller body 31 is rolled while being supported by the guide recess 30*b*.

FIG. 10 illustrates another example of the present invention. In this example, the first roller body 30 and the second roller body 31 according to the above example are replaced with each other. Accordingly, in this example, the first roller body 30 and the first roller 30*a* correspond to the second roller body and the second roller according to this example, respectively, while the second roller body 31 and the second roller 31*a* correspond to the first roller body and the first roller according to this example, respectively.

In addition, the second roller 31*a* of the second roller body 31 plays a role of a receiving roller that comes into contact with the outer surface of the outer panel 4, while the first roller 30*a* of the first roller body 30 plays a role of a compaction roller that bends the panel flange 4*a*.

Figure 10A:
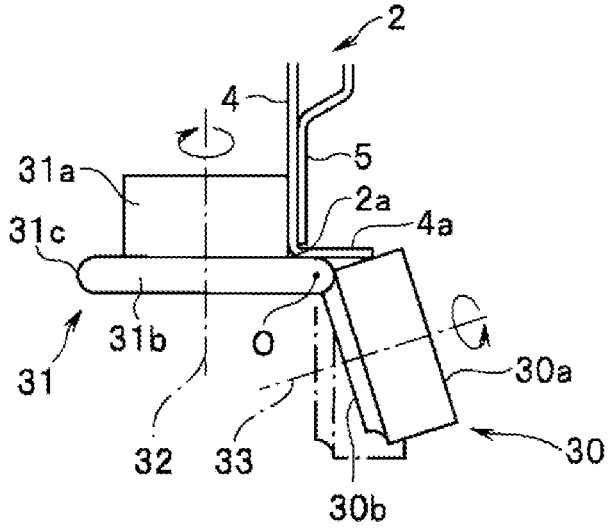
FIGS. 10A, 10B, and 10C are cross-sectional views of hemming processing according to a second example of the present invention, corresponding to FIGS. 4A, 4B, and 4C.
Figure 10B:
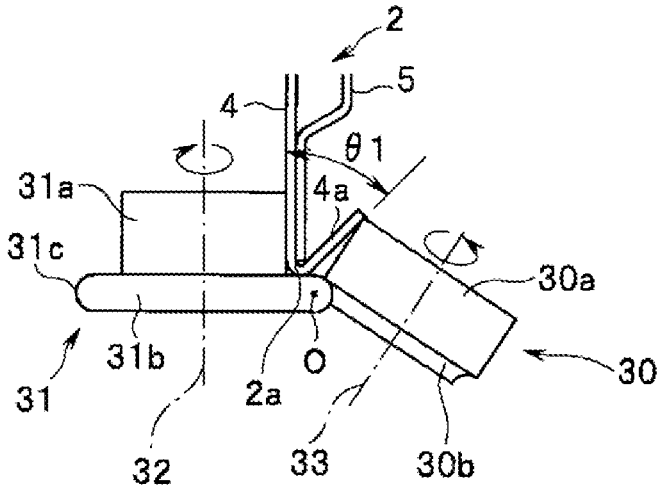
Figure 10C:
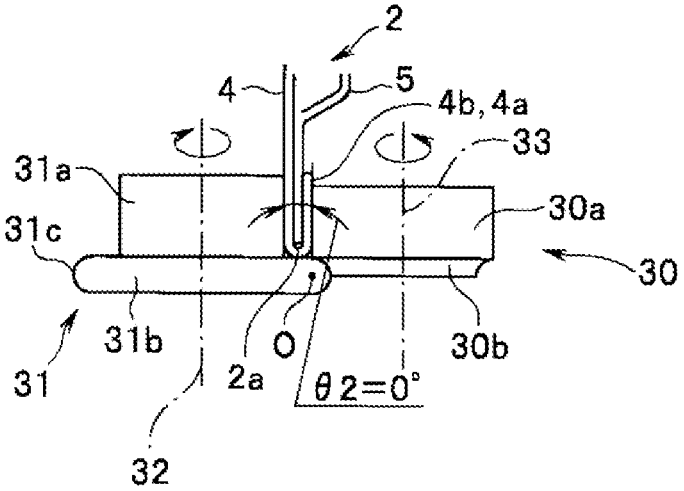

Consequently, in this example, the convex curved surface 31*c* of the roller flange 31*b* formed in the second roller body 31 and the guide recess 30*b* formed in the first roller body 30, when coming into contact with each other, are configured to have the centers of curvature O that are matched with each other and that lie along an extension of the surface of the folded portion 4*b* that is formed by bending the panel flange 4*a*, as illustrated in FIG. 10C, thereby causing the first roller body 30 to be tilted up or down around the center of curvature O.

In this example, the center of curvature O is configured to lie along the extension of the folded portion 4*b*, which provides an effect such as an enlargement of the outer diameter of the roller flange 31*b* to the base of the panel flange 4*a*, in addition to the effect provided by the first example, as illustrated in FIGS. 10A through 10C. As a result, in the process of bending the panel flange 4*a*, the rear wheel arch 2*a* formed at the base end of the panel flange 4*a* can be regulated with regard to the position by causing the rear wheel arch 2*a* to be constantly in sliding contact with the roller flange 31*b* of the second roller body 31. This arrangement enables the edge shape of the rear wheel arch 2*a* to be smoothly formed even if the bending angle of the rear wheel arch 2*a* is continuously varied in the regions E1 through E3 (see FIG. 1B).

Figure 11A:
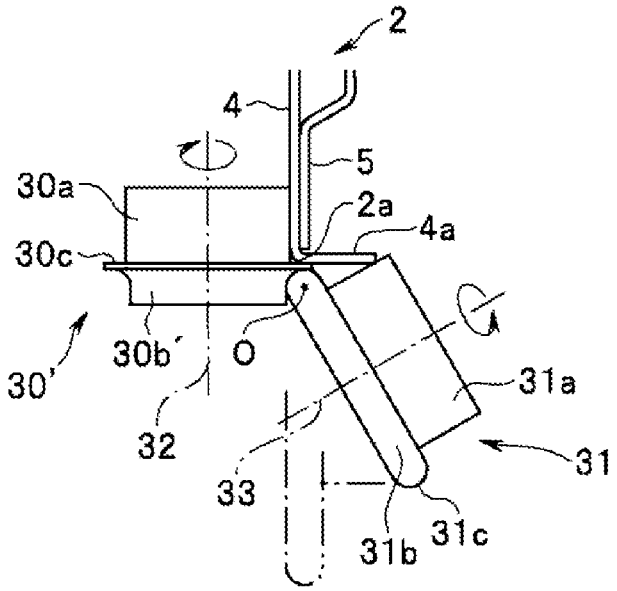
FIGS. 11A, 11B, and 11C are cross-sectional views of hemming processing according to a third example of the present invention, corresponding to FIGS. 4A, 4B, and 4C.
Figure 11B:
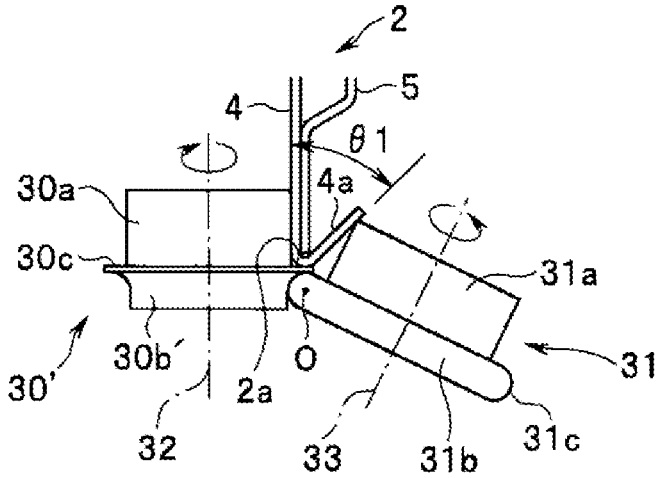
Figure 11C:
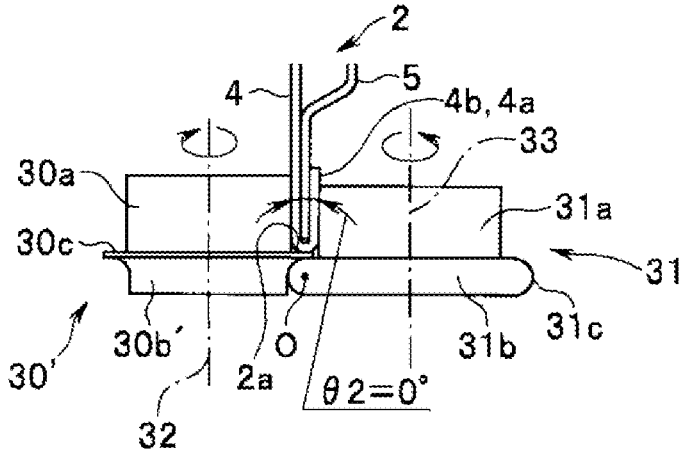

FIGS. 11A, 11B, and 11C illustrate a further example of the present invention. This example is a modification to the above example. The first roller body 30' has a support flange 30*c* that, during hemming processing, comes into contact with the rear wheel arch 2*a* formed at the base of the panel flange 4*a*, and the support flange 30*c* has the guide recess 30*b*' formed thereunder.

The convex curved surface 31*c* of the roller flange 31*b* and the guide recess 30*b*' formed in the first roller body 30', when coming into contact with each other, are configured to have the centers of curvature O that are matched with each other and that lie along an extension of the centerline of a thickness that is the sum of the thicknesses of the folded portion 4*b*, the outer panel 4, and the inner panel 5, the inner panel 5 being held between the folded portion 4*b* and the outer panel 4, as illustrated in FIG. 11C. In addition, the outer diameter of the support flange 30*c* is configured to avoid contact between the support flange 30*c* and the second roller 31*a* when the panel flange 4*a* is folded back by the second roller 31*a* of the second roller body 31, as illustrated in FIG. 11C.

In this example, the first roller body 30' has the support flange 30*c* that comes into contact with the rear wheel arch 2*a* during hemming processing. By causing the rear wheel arch 2*a* to be constantly in sliding contact with the support flange 30*c* of the first roller body 30' in the process of bending the panel flange 4*a*, this arrangement provides an effect such as the capability to smoothly form the edge shape of the rear wheel arch 2*a* even if the bending angle of the rear wheel arch 2*a* is continuously varied in the regions E1 through E3 (see FIG. 1B), in addition to the effects provided by the first and second examples, as illustrated in FIG. 11A.

FIGS. 12A through 12D illustrate a yet another example of this present invention. Though the hemming processing is performed by the first and second roller bodies 30, 31 through the coordinated motion of the first and second hemming robots 22, 23 in the first through third examples, the hemming processing is performed by one hemming robot in this example. The one hemming robot is the first hemming robot 22 illustrated in FIG. 3. Accordingly, the second hemming robot 23 and the second controller 42 that controls the second hemming robot 23 are not required in this example. The reference numerals and symbols in this example refer to the same components as those with the same reference numerals and symbols in the first example, and repeated descriptions of the same components are omitted or simplified.

The rotating shaft 32 of the first roller body 30 that is in contact with the outer surface of the outer panel 4 is rotatably supported by a first roller holding frame 50. In addition, the rotating shaft 33 of the second roller body 31 that bends the panel flange 4*a* formed in the outer panel 4 is rotatably supported by a second roller holding frame 51. The roller holding frames 50, 51 have a U-shaped cross section. The holding frame 50 is supported by a first roller base (hereinafter referred to as "roller base") 28 secured to the first hemming robot (hereinafter referred to as "hemming robot").

Furthermore, the first roller holding frame 50 and the second roller holding frame 51 are fixedly provided with the first and second receiving-side holding holders 50*a* and the first and second compaction-side holding holders 51*a*, respectively. The first receiving-side holding holder 50*a* and the first compaction-side holding holder 51*a* are coupled to each other with a first rotating link mechanism 52A therebetween, while the second receiving-side holding holder 50*b* and the second compaction-side holding holder 51*b* are coupled to each other with a second rotating link mechanism 52B therebetween.

The rotating link mechanisms 52A, 52B bring the guide recess 30*b* formed in the first roller body 30 into contact with the convex curved surface 31*c* of the roller flange 31*b* formed in the second roller body 31 and, with the centers of curvature O being matched, support the second roller holding frame 51 that is rotatable around the center of curvature O. In addition, the second roller holding frame 51 is coupled to an actuator (not illustrated) of a hydraulic cylinder or the like that extends from the roller base 28 or the first roller holding frame 50 side.

Figure 12A:
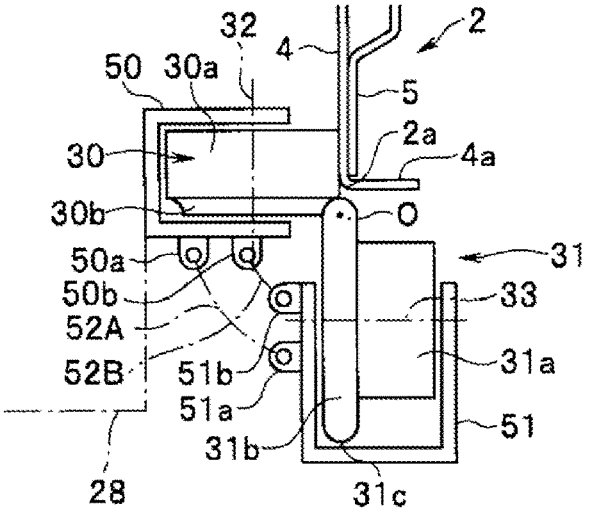
FIGS. 12A through 12D illustrate a positional relationship between a first roller and a second roller during hemming processing according to a fourth example of the present invention.
Figure 12B:
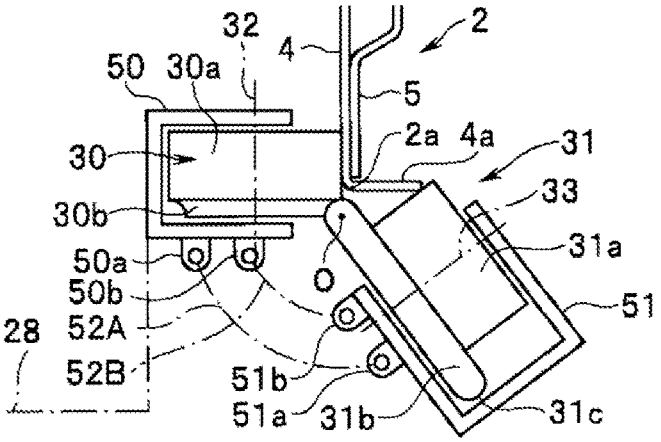
Figure 12C:
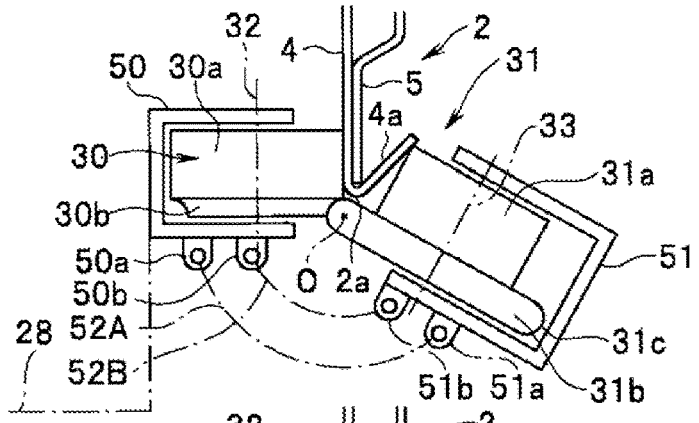
Figure 12D:
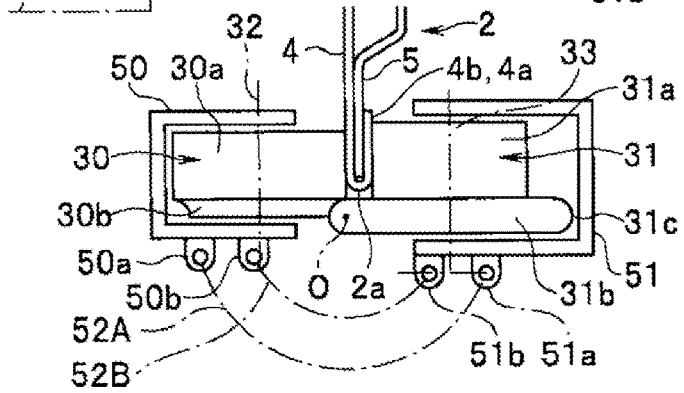

As illustrated in FIG. 12A, the second roller holding frame 51 in an initial state stands by in such a manner as to be inclined at approximately 90 degrees relative to the first roller holding frame 50. Hemming processing is performed by tilting up the second roller holding frame 51 in the counterclockwise direction from the initial state. In addition, when the first roller 30*a* and the second roller 31*a* oppose each other at the tilting-up angle of 0 degrees that is the final bending angle, as illustrated in FIG. 12D, a clearance between the rollers 30, 30*a* is configured to be substantially equal to the sum of the thicknesses of the outer panel 4, the panel flange 4*a*, and the inner panel 5.

Before causing the hemming robot 22 to provide control action via the first robot controller (hereinafter referred to as "robot controller") 41 for performing hemming processing, in the outward path, the main controller 43 first brings the first roller 30*a* of the first roller body 30 into contact with the outer surface of the outer panel 4 in the initial region E1 at the front portion of the rear wheel arch 2*a* illustrated in FIG. 1B (see FIG. 12A). Then, through the operation of the actuator, the second roller body 31 supported via the first and second rotating link mechanisms 52A, 52B is tilted up in the counterclockwise direction to bring the second roller 31*a* into contact with the panel flange 4*a* (see FIG. 12B).

After that, the main controller 43, through the motion of the hemming robot 22, moves the first and second roller bodies 30, 31 along the rear wheel arch 2*a* close to a boundary or the preliminary bending start position between the preliminary bending region E2 and the initial region E1 at the front portion. While being moved along the rear wheel arch 2*a*, the second roller body 31 is tilted up at a predetermined tilting-up angle at which a section of the panel flange 4*a* ranging from the preliminary bending region E2 at the front portion to the final bending region E3 to the preliminary bending region E2 at the rear portion is bent (see FIG. 12C).

Next, the second roller body 31 is gradually tilted down from the end position in the preliminary bending region E2 at the rear portion, and preliminary bending in the outward path is completed.

Next, in the homeward path, the main controller 43 moves the first and second roller bodies 30, 31 along the rear wheel arch 2*a* close to a boundary or the final bending start position between the preliminary bending region E2 and the final bending region E3 at the rear portion. While being moved along the rear wheel arch 2*a*, the second roller body 31 is further tilted up at a final bending angle θ2 (=0 degrees) at which a preliminarily bent section of the panel flange 4*a* in the final bending region E3 is bent, thereby forming the folded portion 4*b* (see FIG. 12D). Finally, the second roller body 31 is gradually tilted down from the end position of the final bending region E3, and the final bending for the homeward path is completed.

As described above, in this example, the first and second roller bodies 30, 31 are supported by the first and second roller holding frame 50, 51, respectively, while the second roller holding frame 51 is supported on the first roller holding frame 50 via the rotating link mechanisms 51A, 52B. In addition, the first roller holding frame 50 is secured to the hemming robot 22, and an actuator is used to tilt up the second roller holding frame 51 to perform hemming processing, which provides an effect such as the capability to perform hemming processing using one robot and a consequent reduction in equipment cost, in addition to the effects described above.

The present invention is not limited to the examples described above and may use an electric motor to autonomously rotate both of the roller bodies 30 (30'), 31 in synchronization with their movement along the rear wheel arch 2*a*. In addition, the bending angle of the panel flange 4*a* used in the above examples are given as an example. Any bending angle can be given through the configuration of the tilting-up angle of the compaction roller bodies.

The invention claimed is:

1. A roller hemming apparatus comprising:

a receiving body comprising a receiving member configured to come into contact with an edge of a panel workpiece;

a roller body comprising a roller member configured to bend a panel flange provided to the edge of the panel workpiece toward the receiving member;

a first robot configured to move the roller body along the edge of the panel workpiece, and configured to pivot the roller body so as to bend the panel flange;

a second robot configured to move the receiving body; and one or more controllers that send command signals for causing the first robot and the second robot to act, wherein either one of the receiving body and the roller body comprises a guide recess and another of the receiving body and the roller body comprises a convex curved surface that is configured to come into sliding contact with the guide recess;

wherein the guide recess and the convex curved surface have a same curvature;

wherein the one or more controllers cause the roller body, while the roller body is moving along the edge of the panel workpiece in a state where the convex curved surface contacts with the guide recess, to pivot about a center of curvature common to the convex curved surface and the guide recess by sliding contact of the convex curved surface with the guide recess;

wherein the one or more controllers are configured to command the first robot and the second robot, causing the roller body and the receiving body to perform an outward path hemming process in which the roller body and the receiving body move from a front portion to a rear portion of the panel flange, adjusting a bending angle of the panel flange through movement from the front portion to the rear portion of the panel flange; and wherein the one or more controllers are configured to command the first robot and the second robot, causing the roller body and the receiving body to perform a homeward path hemming process in which the roller body and the receiving body move from the rear portion to the front portion of the panel flange, adjusting the bending angle of the panel flange through movement from the rear portion to the front portion of the panel flange.

2. The roller hemming apparatus according to claim 1, wherein the center of curvature is configured to lie along an extension of a surface of the panel workpiece with which the receiving member comes into contact.

3. The roller hemming apparatus according to claim 2, wherein the receiving body has a supporting flange that is configured to support an edge of the panel flange that is configured to be bent by the receiving body.

4. The roller hemming apparatus according to claim 3, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

5. The roller hemming apparatus according to claim 2, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

6. The roller hemming apparatus according to claim 1, wherein the center of curvature is configured to lie along an extension of a surface of the panel flange that is folded toward an inner surface of the panel workpiece.

7. The roller hemming apparatus according to claim 6, wherein the receiving body has a supporting flange that is configured to support an edge of the panel flange that is configured to be bent by the receiving body.

8. The roller hemming apparatus according to claim 7, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

9. The roller hemming apparatus according to claim 6, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

10. The roller hemming apparatus according to claim 1, wherein the center of curvature is configured to lie along an extension of a centerline between a surface of the panel workpiece with which the receiving member is configured to come into contact and a surface of the panel flange that is formed by folding back the panel workpiece.

11. The roller hemming apparatus according to claim 10, wherein the receiving body has a supporting flange that is configured to support an edge of the panel flange that is configured to be bent by the receiving body.

12. The roller hemming apparatus according to claim 10, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

13. The roller hemming apparatus according to claim 1, wherein the receiving body has a supporting flange that is configured to support an edge of the panel flange that is configured to be bent by the receiving body.

14. The roller hemming apparatus according to claim 13, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

15. The roller hemming apparatus according to claim 1, wherein the receiving member is a first roller member and the receiving body is a first roller body, while the roller member is a second roller member and the roller body is a second roller body;

wherein the first roller body and the second roller body are rotatably supported by a first roller holding frame and a second roller holding frame, respectively;

wherein the second roller holding frame and the first roller holding frame are coupled to each other so as to be rotatable around the center of curvature; and wherein an actuator that is configured to tilt the second roller body up or down is coupled to the second roller holding frame.

16. The roller hemming apparatus according to claim 1, wherein the one or more controllers are configured to:

position, in the outward path hemming process, the roller body and the receiving body so that at least a region of the panel flange is bended at a first degree, and position, in the homeward path hemming process, the roller body and the receiving body so that the region of the panel flange is bended at a second degree that is less than the first degree.

17. The roller hemming apparatus according to claim 1, wherein the one or more controllers are configured to:

position, in the outward path hemming process, the roller body and the receiving body so that a first region of the panel flange is bended at a first degree, and position, in the homeward path hemming process, the roller body and the receiving body so that a second region of the panel flange is bended at a second degree that is less than the first degree, wherein the first region includes the second region, and the second region is narrower than the first region.

18. A roller hemming method by which a receiving member provided on a receiving body is brought into contact with an edge of a panel workpiece, and a panel flange provided to an edge of the panel workpiece is bent by a roller member provided on a roller body toward the receiving member and, at the same time, the roller body is moved along an edge of the panel workpiece so as to hem the panel flange, comprising:

forming a guide recess having a predetermined curvature in either one of the receiving body and the roller body and forming a convex curved surface having the same curvature as the guide recess in the other;

bringing the guide recess into sliding contact with the convex curved surface;

pivoting, while the roller body is moving along the edge of the panel workpiece in a state where the convex curved surface contacts with the guide recess, the roller body about a center of curvature common to the guide recess and the convex curved surface and thereby varying a bending angle of the panel flange;

moving the roller body and the receiving body, in an outward path hemming process, from a front portion to a rear portion of the panel flange, adjusting the bending angle of the panel flange through movement from the front portion to the rear portion of the panel flange; and moving the roller body and the receiving body, in a homeward path hemming process, from the rear portion to the front portion of the panel flange, adjusting the bending angle of the panel flange through movement from the rear portion to the front portion of the panel flange.

19. The roller hemming method according to claim 18, wherein the roller body is configured to be moved along an edge of the panel workpiece and, at the same time, the bending angle of the panel flange is adjustable throughout a movement of the roller body.

20. A roller hemming apparatus comprising:

a receiving body comprising a receiving member configured to come into contact with an edge of a panel workpiece;

a roller body comprising a roller member configured to bend a panel flange provided to the edge of the panel workpiece toward the receiving member;

a first robot configured to move the roller body along the edge of the panel workpiece, and configured to pivot the roller body so as to bend the panel flange;

a second robot configured to move the receiving body; and one or more controllers that send command signals for causing the first robot and the second robot to act, wherein either one of the receiving body and the roller body comprises a guide recess and another of the receiving body and the roller body comprises a convex curved surface that is configured to come into sliding contact with the guide recess, wherein the guide recess and the convex curved surface have a same curvature, wherein the controller causes the roller body, while the roller body is moving along the edge of the panel workpiece in a state where the convex curved surface contacts with the guide recess, to pivot about a center of curvature common to the convex curved surface and the guide recess by sliding contact of the convex curved surface with the guide recess, and wherein the controller is, while the roller body is moving along the edge of the panel workpiece, configured to continuously vary an angle between a surface of the roller body and a surface of the receiving body that face each other to continuously vary a bending angle of the panel flange.

* * * * *